United States Patent [19]

Berger

[11] 4,074,798

[45] Feb. 21, 1978

[54] ENCODED PRINT WHEEL SYSTEM

[75] Inventor: Michael A. Berger, Richardson, Tex.

[73] Assignee: Xerox Corporation, Stamford, Conn.

[21] Appl. No.: 719,630

[22] Filed: Sept. 1, 1976

[51] Int. Cl.[2] ..... B41J 1/30

[52] U.S. Cl. ..... 197/53; 197/18

[58] Field of Search ..... 197/18, 49, 53, 54, 197/84 R, 84 B, 19; 101/93.15–93.19

[56] References Cited

U.S. PATENT DOCUMENTS

| | | | |
|---|---|---|---|
| 3,858,509 | 1/1975 | Grundherr | 197/54 X |
| 3,905,463 | 9/1975 | Boyce et al. | 197/84 B X |
| 3,949,853 | 4/1976 | Lahr et al. | 197/53 |
| 3,954,163 | 5/1976 | Gabor | 197/53 |

FOREIGN PATENT DOCUMENTS

| | | | |
|---|---|---|---|
| 129,801 | 10/1932 | Austria | 197/84 B |

OTHER PUBLICATIONS

*An Arrangement for Encoding the Impact Energy for Associated Characters in a Serial Printer,* Gordon Sohl, Xerox Disclosure Journal, vol. 1, Nos. 9/10, Sept./Oct. 1976, p. 25.

*Character Wheel for Low-Cost Changeable Font Printer,* IBM Technical Discl. Bulletin, C. A. Branson, et al., vol. 16, No. 5, Oct. 1973, p. 1515.

*Primary Examiner*—Paul T. Sewell

[57] ABSTRACT

A method and apparatus for providing variable print hammer energy information and variable character spacing information for every character of every font in an electronic typing system having interchangeable print wheels, wherein the individual print wheels carry self-descriptive information in coded form on a read-only memory. The descriptive information is encoded on a portion of the print wheel and contains, in high density, machine readable, permanent form, sufficient coded data to instruct the electronic typing system as to the optimal use of the particular font of characters contained on the type wheel. In a preferred embodiment, a single initializing revolution of the print wheel upon each insertion or machine start-up cycle serves to load the encoded data into a read/write memory for subsequent call-up and use by the electronic typing system during the print-out of each character. The data is serially encoded on the print wheel for reading by single track optional sensing apparatus. Alternate embodiments using parallel data tracks and magnetic sensing apparatus are discussed.

21 Claims, 6 Drawing Figures

Fig. 1.
PRIOR ART
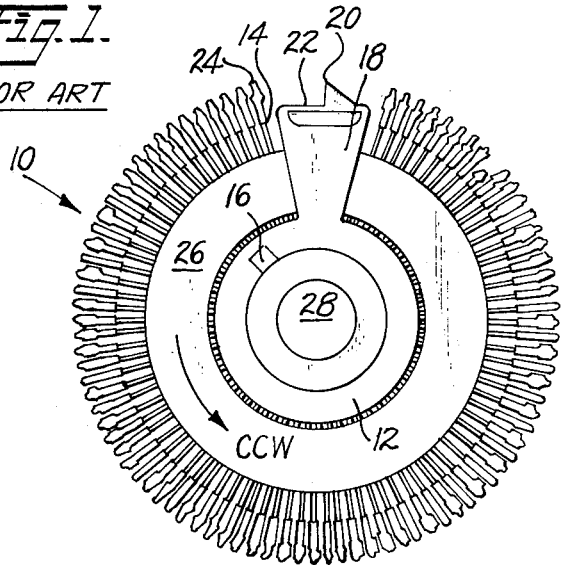
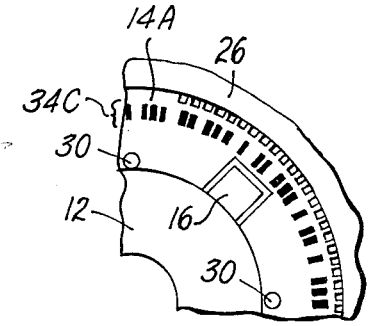
Fig. 2C.
Fig. 2.
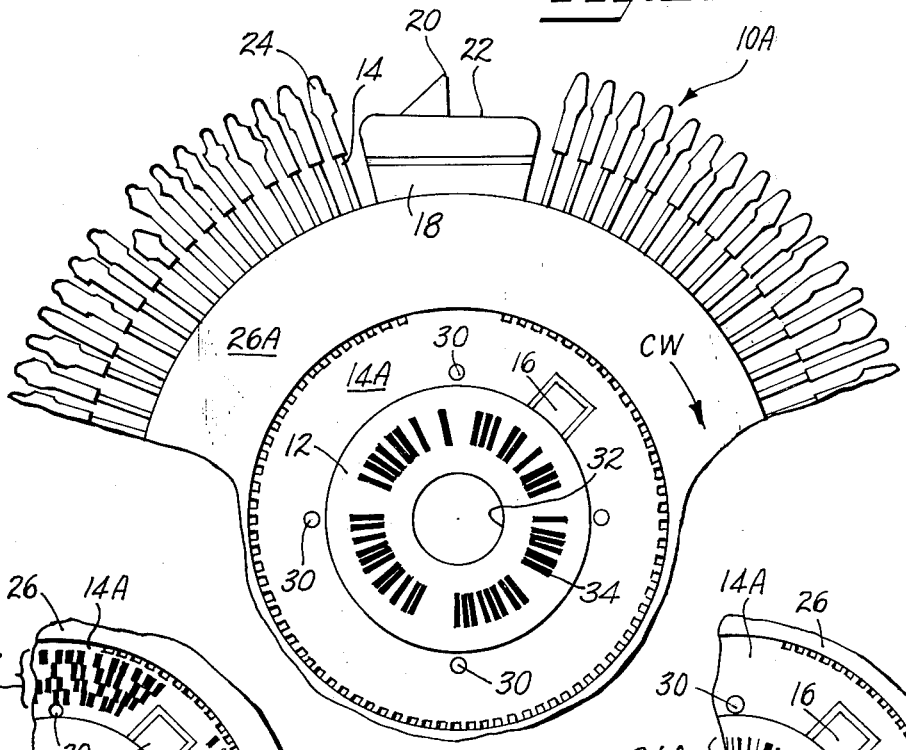
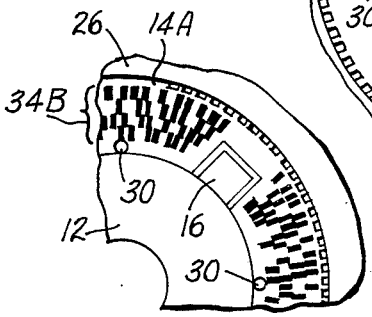
Fig. 2B.
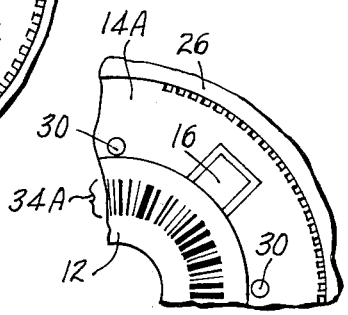
Fig. 2A.

ENCODED PRINT WHEEL SYSTEM

BACKGROUND OF THE INVENTION

1. Field of the Invention

This invention relates to electronic typing systems in general and, in particular, to a typing system having readily interchangeable type character carrying elements such as disc shaped print wheels or the like.

More specifically, this invention relates to an encoding system suitable for use with an electronic typing system wherein the type-bearing print wheel contains self-descriptive information in coded form.

2. Description of the Prior Art

Electronically controlled typing systems of a large variety of capabilities and types are, of course, well known in the electronics-graphics art. They range from the early basic teletype devices to the modern high-speed, computer-driven peripherals. In recent years, the automatic typing/printing technology previously developed has been applied to smaller machines as would be encountered in office typewriters and the like. This trend has provided the impetus for more versatile devices capable of producing higher quality printing. In addition to the well-known proportional spacing and automatic line justification features, other items for improving copy quality, such as controlling the print hammer energy for each character and providing for a variety of type fonts, have also been incorporated into the more recent machines. Representative U.S. patents disclosing various of these features, as related to the techniques for accomplishing the internal control functions required to implement them, are found in U.S. Pat. No. 3,805,940 to Stockham, U.S. Pat. No. 3,168,182 to Bernard et al. and U.S. Pat. No. 2,965,010 to Higonnet et al.

SUMMARY OF THE INVENTION

It is, therefore, an object of this invention to provide improved apparatus for use in electronically controlled printing systems.

A further object of the present invention is to provide a print element which carries, as an integral part thereof, self-descriptive data in the form of a coded read-only memory.

A further object of the present invention is to provide a print element carrying self-descriptive information wherein the parameters of character width and optimum print hammer energy for each character are self-contained.

A further object of the present invention is to provide an improvement to electronic typing systems wherein the energy and width information for printing a particular character is available immediately after the character is selected without the delays associated with waiting for a character print element to reach its printing position.

A further object of the present invention is to provide a print element wherein the self-contained coded information is not keyed to a particular character location on the element, thereby eliminating critical registration requirements.

A still further object of the present invention is to provide a simpler, less costly and more versatile electronic typing system by eliminating the large storage needed to accommodate a large number of different print elements from the electronic processor and instead using a single storage device, which is loaded by each print element inserted into the system.

BRIEF DESCRIPTION OF THE DRAWINGS

Additional objects and advantages of the invention will become apparent to those skilled in the art as the description proceeds with reference to the accompanying drawings wherein:

FIG. 1 is a plan view of a print wheel according to the prior art;

FIG. 2 is a fragmentary plan view of a print wheel according to the instant invention, enlarged to show the print wheel encoding in greater detail;

FIGS. 2A–2C are fragmentary plan views of a print wheel showing alternate embodiments of the encoded read-only memories.

DETAILED DESCRIPTION OF THE PREFERRED EMBODIMENT

Figure 3:
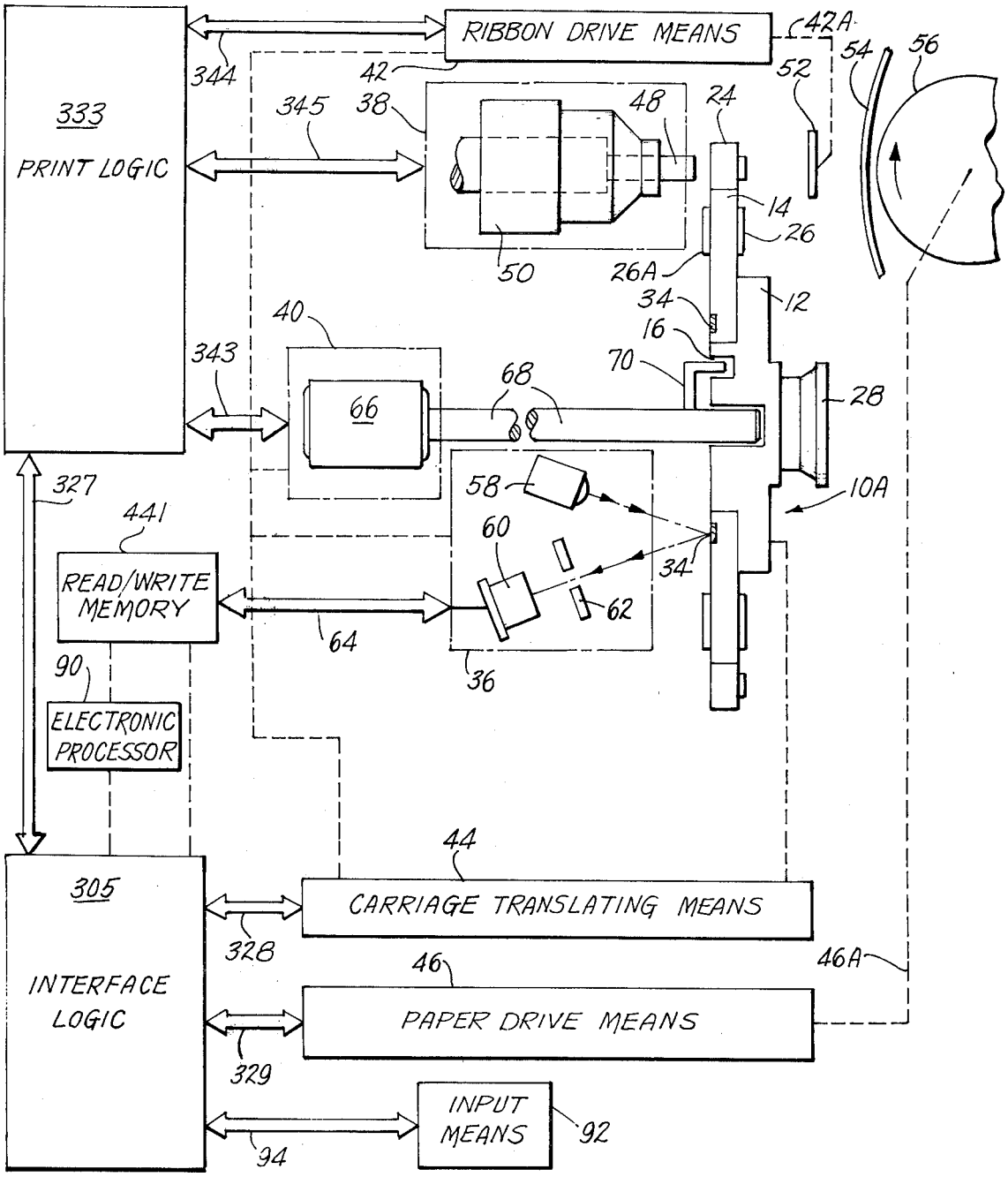
FIG. 3 is a simplified schematic view of portions of the printing mechanism, in combination with a block diagram of the printer interface circuits.

Referring now to FIG. 1 there is shown a print wheel illustrative of a prior art device used in connection with a serial impact printer portion of an electronic typing system to which the improvement comprising the instant invention may be applied. A print wheel 10 comprises an inner hub portion 12, which includes a notch 16 for aligning the print wheel 10 at a fixed angular index position with respect to the printing apparatus utilized. The hub 12 also includes a flag 18 extending radially outward amidst the spokes 14 and terminating in a pointer 20 and a flat portion 22, which provide a means to align the typed line with the print wheel 10 and allow viewing by the typist of the printed character. A plurality of spokes 14 extend from a circular disc 14A (see FIG. 2) which is attached to the hub 12. The outer end of each spoke 14 is formed with a character slug 24 that has a particular character formed on the printing surace of the character slug and an impact surface formed on the opposite side of the character slug. The printing surface of the character slug 24 faces the platen of the serial impact printer while the impact surface faces and is contacted by the print hammer (not shown) after the character slug has been rotated to the print position. The positioning of the print wheel 10 relative to the print hammer and other portions of the typing system is shown more clearly in FIG. 3 and is discussed in detail in connection therewith. In the view as shown in FIG. 1, the print wheel 10 rotates counterclockwise as indicated by the arrow CCW for illustrative purposes.

Each character slug 24 has a different character thereon whereby a set or font of characters is formed on the plurality of character slugs 24 for each print wheel 10. There are a total of 88 spokes 14 (with associated character slugs 24), each of which is aligned symmetrically with respect to the centerline of one of 88 of the equally-spaced (3°45′) 96 centerlines designated with respect to the print wheel 10. The flag 18 occupies an area covering eight of the 96 centerlines, which includes the zero (0) home position. In another embodiment, there are a total of 92 spokes (with associated character slugs), each of which is aligned symmetrically with respect to the centerline of one of 92 of the equally-spaced 96 centerlines. In this embodiment, the flag occupies an area covering four of the 96 centerlines. The character slugs 24 are formed on the end of the spokes 14 by a process on injection molding. A circular disc 26 of flexible material is adhesively attached to the inner portions of the spokes 14 so as to flexibly couple them together. A knob 28 fits onto the hub 12 to facilitate the manual insertion and removal of the print wheel 10 from the serial impact printer.

For illustrative purposes, many conventional print wheels of the daisy wheel type having an appropriately spaced print font for use with a serial impact printer may be described. However, due to the rapidity with which printing occurs in the electronic typing system of the exemplary embodiment set forth hereinbelow, the preferred print wheel is of the type set forth in FIG. 1 and more fully disclosed in U.S. Pat. No. 3,949,853 entitled "Proportional-Spaced Character Print Wheel", issued to R. J. Lahr et al on Sept. 25, 1974; and U.S. patent application Ser. No. 509,193 as filed in the name of G. Sohl et al. on Sept. 25, 1974. Both of these prior art disclosures are incorporated herein by reference.

Referring now to FIG. 2, there is shown a fragmentary view of a print wheel 10A according to the instant invention. This view shows the obverse side of the print wheel shown in FIG. 1 and is slightly enlarged to show selected features on the instant invention in greater detail. It should be noted that the print wheel 10A of FIG. 2 is structurally substantially similar to the print wheel 10 of FIG. 1. The differences, which comprise the improvement according to the present invention, will be described in detail hereinbelow. Briefly, the print wheel 10A contains encoded information in the form of a read-only memory (hereinafter ROM) which describes particular characteristics of the font being carried by the print wheel. The ROM may take the form of optical or magnetic indicia arranged in a circular manner and may be carried either by the hub or the inner portion of the spoke carrying structure. Hereinafter, for clarity of discussion, the sides of the print wheels will be designated as either the printing surface side or the impact surface side (alternately, the ROM side) in keeping with the terminology introduced above. FIG. 1 shows the printing surface side of print wheel 10. FIG. 2 shows the impact side of print wheel 10A, which is the side which carries the ROM and is viewed by the operator of the electronic typing system during normal operations. The impact side of the print wheel 10A rotates clockwise for illustrative purposes, as indicated by the arrow CW of FIG. 2.

On the ROM side of the print wheel 10A, a continuous circular band 26A is provided, as compared to the band 26 of print wheel 10, which is interrupted to accommodate the flag 18. Also shown in FIG. 2 is a circular disc 14A, which is attached to the hub 12 by a plurality of retaining means 30 and constitutes an integral assembly whereupon all of the spokes 14 terminate. A cylindrical aperture 32 has as its longitudinal axis a line orthogonal to the surface defined by the spokes 14 and the integral circular disc 14A, which longitudinal axis defines the nominal center of the circle formed by the plurality of character slugs 24. This axis is also the print wheel rotational drive axis. In operation, the print wheel 10A is installed on an associated electronic typing system such that a drive shaft (not shown) mates with the aperture 32 to provide rotational (CW and/or CCW) control for character selection.

A code-bearing region 34, which comprises a disc-shaped surface concentric with the axis of print wheel 10A and contained upon the surface of the hub 12, carries the ROM whereby the print wheel 10A may completely identify itself to its cooperating electronic typing system. The configuration shown in FIG. 2 represents a preferred embodiment of the ROM coding arrangement characterized by providing the coded information in serial digital form having the coded information arrayed in a continuous circle and adapted to be read by optical means. Alternate embodiments of the ROM, wherein the coded information is arrayed in parallel form, or wherein the encoding scheme is accomplished by means of line width modulated bars, are shown in FIGS. 2A–2C.

FIG. 2A shows the line width modulated arrangement of the type commonly found on food product packages. In common with the arrangement of FIG. 2, the coded indicia are positioned to occupy substantially the full 360° available on the hub 12. FIG. 2B shows a parallel digital code arranged on the circular disc 14A portion of the print wheel 10A. In the print wheel of the preferred type, this circular disc 14A is metallic, and thus the coded indicia are applied in some suitable form, such as shallow etching, and/or baked-in reflective pigment. FIG. 2C shows an alternate location for the code-bearing region 34. Here the indicia are arrayed serially along the largest circumference available on the circular disc 14A. It is equally feasible to locate the indicia elsewhere on the print wheel 10A including, for example, on the spokes 14.

While not specifically shown, it should be understood that all of the encoding types and locations described herein may include at least an index position designating a start of message to the code-reading means and may also include such additional features as an end-of-message portion, synch bits, parity bits and the like as are well known and conventional. For all of the encoding arrangements described, the manner of affixing the indicia is of secondary importance as compared to the requirements of providing indicia of good contrast ratio, physical dimensions compatible with the desired bit densities and good permanence. These criteria would apply to indicia for use with any type of reading means, be it optical, magnetic or some other technique.

For a print wheel containing 88 character slugs 24 and, for illustrative purposes, defining two three-bit words to delineate print hammer energy and character width, a total of at least 528 indicia positions are needed. Either optical or magnetic coding/reading means would readily support bit densities of that order.

Referring now to FIG. 3, there is shown a simplified schematic view of the print wheel 10A along with several key pprtions of the printing mechanism, in combination with an overall block diagram of the interface circuits associated with the printing mechanism. The print wheel 10A is shown operatively coupled to a ROM sensing means 36, a print hammer actuating means 38 and a print wheel positioning means 40. Also shown is a ribbon drive means 42, which, along with the elements 10A, 36, 38 and 40 are all transported by a carriage translating means 44. (Dotted lines are used herein to indicate appropriate mechanical interconnections.) Briefly, these portions of the printing mechanism serve to perform the following functions: (1) The positioning means 40 serves primarily to position the designated spoke on the print wheel to a position for printing when driven by appropriate printing logic signals supplied by the electronic typing system via a print logic 333. Alternately, and of primary importance to the instant invention, the positioning means 40 serves to rotate the print wheel one complete revolution in response to signals indicating that a print wheel has just been installed or a machine start-up circle has occurred and a printing sequence is being commanded. This initial single rotation commences from a zero or index position and continues for 360 degrees under the control of appropriate initializing logic signals also supplied via the print logic 333. (2) The ROM sensing means 36 serves to read the coded information carried by the print wheel during the initial single revolution sequence. Thus, the print character descriptive information stored on the print wheel ROM is converted into electronic signals and routed to a read/write memory within the electronic typing system for subsequent use. As shown in FIG. 3, the preferred embodiment of the ROM sensing means 36 employs an optical reflectant sensing means. (3) The print hammer actuating means 38 serves to effect the desired printing action by impacting the predetermined character slug on the print wheel. The print hammer is actuated in response to signals supplied via the print logic 333, which signals include information for impacting the print hammer with eight predetermined energy levels corresponding to the variations in surface areas of the character being printed. (4) The ribbon drive means 42 is an unwind-/takeup reel mechanism which serves to provide a fresh portion of ribbon for use in printing of each character. It also is actuated in response to signals supplied via the print logic 333.

In short, the exemplary printing mechanism outlined above, with the exception of the ROM 34 and the ROM sensing means 36, is substantially similar to the one that is presently in use in the Xerox 800 Electronic Typing System. Further details of the printing mechanism and the electronic control portion of the printing system, while not essential to an understanding of the instant invention, may be had by reference to commonly assigned U.S. Pat. No. 3,954,163 entitled "High Speed Printer With Intermittent Print Wheel and Carriage Movement", issued to Andrew Gabor on May 4, 1976, and copending U.S. patent application entitled "Automatic Writing Systems and Methods of Word Processing Therefor", Ser. No. 622,780, filed on Oct. 15, 1975, in the name of H. Wallace Swanstrom et al, which patent and application are hereby incorporated by reference. For ease of comparison, the 300 and 400 series of numbers of FIG. 3 correspond to similarly numbered elements of the Swanstrom et al application. For present purposes, it is sufficient to observe that the electronic typing system employs a serial impact printer which acts as the output device for the system. As the output device may also include a keyboard, say as part of a typewriter-like assembly, which would then provide at least one input means for the electronic typing system, it becomes apparent that the terms "printing" and "typing" may be used interchangeably herein without implying a significant difference in function. Both terms refer to the output means of the exemplary embodiment which produces the desired character replications. Thus, also the terms "10 pitch", "12 pitch" and "proportional spacing" of conventional typewriter terminology are combined with terms such as character "set width" from letterpress terminology where each term implies its conventional meaning while used in a combined environment.

The operation of the printing mechanism is set forth in detail in the aforementioned patent of Andrew Gabor and copending application of H. Wallace Swanstrom et al. However, three principle functions of the mechanism should be briefly noted for an appreciation of the operation of the mechanism of FIG. 3 and particularly of its interconnection with the print logic 333 and an interface logic 305.

Briefly, each of these three principle functions are independently controlled by logical inputs provided to the printing mechanism and may be generally described in terms of three basic printer motions: print wheel displacement associated with character printing, carriage displacement associated with character escapement (character spacing, carriage return operations and the like) and paper-feed motions associated with line spacing and other indexing functions. The control signals to implement each motion are supplied through digital data lines to the printing mechanism wherein the data lines transmit: (a) a data word (typically 12 bits) specifying the direction and displacement to be moved by the carriage in multiples of 120th of an inch from an interface logic 305 via a plurality of lines 328 to the carriage translating means 44; (b) a data word (typically 12 bits) which specifies the direction and number of vertical line space indices that the paper is to be displaced through paper-feed functions in multiples of 1/48th of an inch, also from the interface logic 305, via a plurality of lines 329 to a paper-drive means 46, which in turn drives a paper-bearing platen 56 via an interconnection means 46A; and (c) a 12-bit word containing print wheel position information on seven of the 12 bits, a three-bit part which specifies character width, and a two-bit part defining the level of hammer print intensity for the next character to be printed. This last 12-bit word of three parts is derived from the interface logic 305 and is passed to the print logic 333 via a plurality of lines 327, thereafter it is routed as follows. The bits for positioning the print wheel are routed from the print logic 333 via a plurality of lines 343 to the print wheel positioning means 40. The bits which specify character width are routed via a plurality of lines 344 to the ribbon drive means 42 which, in turn, drives a ribbon 52 via an interconnection means 42A. The bits which specify print hammer energy are routed via a plurality of lines 345 to the print hammer actuating means 38. Whereas the exemplary control electronics outlined above, which correspond to the embodiment disclosed in the U.S. application of Swanstrom et al., sets forth a two-bit granularity (i.e. four states) for controlling print hammer energy, the preferred embodiment of the instant invention contemplates the use of three bits (eight states) for the same purpose.

With continued reference to FIG. 3, a detailed description shows the print hammer actuating means 38 as comprised of a print hammer 48 which is slidingly guided in a sleeve 50 for a reciprocating movement toward and away from the impact surface of the character slug 24 of the print wheel 10A. Conventionally, the printing surface of the character slug 24 is impacted against the ribbon 52, a recording medium 54, which may be paper or the like, and finally against the platen 56. The print hammer is actuated by an electromagnet (not shown) contained within the print hammer actuating means 38. The control for the print hammer electromagnet is supplied by print logic 333 in the form of a three-bit code via the lines 345 for causing the energizing current to be selected from one of a plurality of different current levels, thereby imparting a number of predetermined impact energy levels to the print hammer 48. The instant invention contemplates the use of eight predetermined impact energy levels for each character printed as defined by three bits of digital information initially derived by a reading of the indicia contained on the read-only memory 34. Further details of an exemplary mechanism for implementing an electronically controlled variable impact energy print hammer may be found in a copending U.S. application assigned to the same assignee as the instant invention entitled "Hammer Solenoid Drive", Ser. No. 622,582, filed Oct. 15, 1975, in the name of David R. Deetz and which is hereby incorporated by reference.

The ROM sensing means 36 is shown as comprising a light source 58, a photodetector 60 and an aperture mask 62. In operation, the light source 58 directs a beam of focused light onto the reflective indicia of the ROM 34 during relative movement between the print wheel 10A and the ROM sensing means 36. That is, during the at least one initializing revolution of the print wheel 10A, the encoded information contained in the ROM 34 is sensed and converted into appropriate signals by the ROM sensing means 36. The reflected images of the individual code elements of ROM 34 are focused on the photodetector 60 through the shaped aperture mask 62. While not specifically illustrated in FIG. 3, it will be appreciated that appropriate lens systems may be used to focus both the light beam from the light source 58 and the reflected images onto the photodetector 60. The output of the photodetector 60 is routed via a line 64 to a read/write memory 441. Read/write memory 441 corresponds to a read-only memory 441 in the aforementioned copending application to H. Wallace Swanstrom et al. The utilization of a read/write memory herein, with data loaded from ROM 34 of print wheel 10A, permits a unique and unambiguous technique for providing different character data to the print system electronics dependent upon the print wheel selected. This technique greatly enhances the versatility of the electronic printing system.

FIG. 3 also shows a microprocessor 90 which controls the overall operation of the electronic printer system. The microprocessor (element 16) in aforementioned copending application to H. Wallace Swanstrom et al. is operatively connected to the read/write memory 441 and to the interface logic 305 as indicated by dotted lines. Character spacing information and print hammer energy data may be extracted from memory 441 as described in the aforementioned application. Also shown is an input means 92, typically a keyboard associated with the printing mechanism, whose output is routed via a plurality of lines 94 to the interface logic 305.

The print wheel positioning means 40 is shown in simplified form as comprising a servomotor 66, which rotationally positions the print wheel 10A by means of a drive shaft 68 and an index means 70. The index means 70 mates with the hub notch 16, which arrangement, in combination with the control logic signals provided via the line 343, establishes the desired phasing of the print wheel 10A. The print wheel positioning means 40 may be implemented by a variety of means, all well known to those skilled in the art, including embodiments wherein a digital closed-loop servo technique is used. To this end, the seven-bit print wheel positioning code via the lines 343 serve to provide the input commands for the digital servo loop.

It should be noted that while the instant invention is directed in part toward providing a print wheel encoded ROM containing data applicable to the self-control of print hammer actuating means 40 and data applicable to the self-control of character width as reflected in the ribbon drive means 42 in addition to the carriage translating means 44, the inclusion of other parameters related to particularities of the print wheel as it is utilized by the electronic typing system is also contemplated herein. For example, the ROM may also contain self-descriptive information relating to global printing options, such as bold-face/light-face options or double-spacing options and the like.

Although the present invention has been described in terms of selected preferred embodiments, the invention should not be deemed limited thereto, since other embodiments and modifications will readily occur to one skilled in the art. It is, therefore, to be understood that the appended claims are intended to cover all such modifications and changes as fall within the true spirit and scope of the invention.

What is claimed is:

1. An electronic printing system having a serial impact printer, an electronic processor, and means for inputting data to be printed, comprising:

a print element connected to said impact printer and having a plurality of characters arrayed thereon, said element having a read only memory containing coded information associated with selected parameters of said characters, said read only memory containing an index position designating a start characters, said read only memory containing an index position designating a start of message;

means for reading the coded information contained in said memory and for converting said coded information into a set of signals;

means for providing at least one complete revolution of the print element with respect to the index position prior to inputting data to the printer for subsequent printing, whereby said coded information is read by said code reading means; and a read/write memory means operatively connected to said reading means and to said electronic processor for receiving and storing said set of signals, whereby said stored signals are provided in said printing system immediately after each character is selected without the delays associated with waiting for a character to reach a print position for printing each character in accordance therewith.

2. An electronic printing system as recited in claim 1 wherein said read-only memory comprises an optical machine readable code and said means for reading is an optical sensing means.

3. An electronic printing system as recited in claim 2 wherein said code comprises a serial optical code.

4. An electronic printing system as recited in claim 2 wherein said code comprises a parallel optical code.

5. An electronic printing system as recited in claim 1 wherein said read-only memory comprises a magnetic machine readable code and said means for reading is a magnetic sensing means.

6. An electronic printing system as recited in claim 5 wherein said code comprises a serial magnetic code.

7. An electronic printing system as recited in claim 5 wherein said code comprises a parallel magnetic code.

8. An electronic printing system as recited in claim 1 wherein said read-only memory is comprised of indicia formed so as to be readable by optical sensing means and arrayed on said element so as to be serially readable by said optical sensing means.

9. An electronic printing system as recited in claim 1 wherein said read-only memory is comprised of indicia formed so as to be readable by magnetic sensing means and arrayed on said element so as to be serially readable by said magnetic sensing means.

10. An electronic printing system as recited in claim 1 wherein said selected parameters comprise at least a quantity related to character face surface area.

11. An electronic printing system as recited in claim 10 wherein said selected parameters additionally comprise a quantity corresponding to each individual width.

12. In an electronically controlled serial impact printing apparatus having means for accommodating a plurality of type fonts by utilizing replaceable character print elements, a method for controlling the energy with which each character is impacted during printing at a print position and for controlling the horizontal spacing between adjacent printed characters, comprising the steps of:

a. providing a print element comprising a font of characters arrayed thereon and a read-only memory, which read-only memory contains information descriptive of at least the desired impact energy for selected characters and of the desired horizontal spacing for selected characters;

b. providing a read/write memory having capacity sufficient to store the contents of said read-only memory;

c. reading said read-only memory into said read/-write memory at least once after the insertion of said element into said printing apparatus thereby storing said descriptive information in said read/-write memory; and d. subsequently utilizing selected portions of said stored descriptive information in connection with the printing of any particular character of said font to control, at least, the impact energy and horizontal spacing with which said particular character is printed without waiting for the particular character to reach the print position.

13. A method as recited in claim 12 wherein said read only memory comprises an optical machine readable code and said reading step comprises optically reading said code.

14. A method as recited in claim 13 wherein said reading step comprises serially reading said code.

15. A method as recited in claim 13 wherein said reading step comprises parallel reading of said code.

16. A method as recited in claim 12 wherein said readonly memory comprises a magnetic machine readable code and said reading step comprises magnetically reading said code.

17. A method as recited in claim 16 wherein said reading step comprises serially reading said code.

18. A method as recited in claim 16 wherein said reading step comprises parallel reading of said code.

19. A method as recited in claim 12 wherein said reading step is accomplished not more than once after each insertion of said element.

20. A method as recited in claim 12 wherein said print element comprises a daisy wheel and said reading step comprises rotating said daisy wheel to accomplish the reading thereof.

21. A method as recited in claim 20 wherein said readonly memory comprises indicia formed so as to be readable by optical means and arrayed so as to be serially readable by said optical means and said reading step comprises serially reading said indicia while rotating said daisy wheel.

* * * * *

UNITED STATES PATENT AND TRADEMARK OFFICE

CERTIFICATE OF CORRECTION

PATENT NO. : 4,074,798

DATED : February 21, 1978

INVENTOR(S) : Michael A. Berger

It is certified that error appears in the above-identified patent and that said Letters Patent are hereby corrected as shown below:

Column 8, delete line 28 in its entirety.

Column 8, delete line 29 up to and including "start".

Column 9, line 9, after "individual" insert --character--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*